United States Patent [19]

Gatti et al.

[11] 4,145,297

[45] Mar. 20, 1979

[54] FUEL AND LUBRICANT COMPOSITIONS FOR INHIBITION OR PREVENTION OF OCTANE REQUIREMENT INCREASE

[75] Inventors: Anthony R. Gatti; James S. Hokanson; Kenzie Nozaki, all of Houston, Tex.

[73] Assignee: Shell Oil Company, Houston, Tex.

[21] Appl. No.: 841,084

[22] Filed: Oct. 11, 1977

Related U.S. Application Data

[62] Division of Ser. No. 614,822, Sep. 19, 1975, Pat. No. 4,092,126.

[51] Int. Cl.[2] ..... C10M 1/10; C10M 3/02; C10L 1/12; C10L 1/32

[52] U.S. Cl. ..... 252/25; 44/51; 44/67; 252/28

[58] Field of Search ..... 252/25, 28; 44/51, 58, 44/67

[56] References Cited

U.S. PATENT DOCUMENTS

| | | | |
|---|---|---|---|
| 2,725,857 | 12/1955 | Hughes et al. | 252/25 |
| 2,902,351 | 9/1959 | Stokes | 252/28 |
| 2,965,568 | 12/1960 | Marsden et al. | 252/28 |
| 3,399,145 | 8/1968 | Martinek | 252/25 |
| 3,817,722 | 6/1974 | Scott | 44/51 |
| 3,994,699 | 11/1976 | Scott | 44/51 |

*Primary Examiner*—Delbert E. Gantz
*Assistant Examiner*—Irving Vaughn
*Attorney, Agent, or Firm*—Ronald R. Reper

[57] ABSTRACT

The prevention or substantial reversal of octane requirement increase in a spark-ignited, internal combustion engine is achieved by introducing, with the combustion intake charge, a fuel and/or lubricant composition containing an octane requirement increase-inhibiting amount of a high surface area, solid acid catalyst having an average particle size in the range of about 0.01 to 10 microns and an average non-volatile surface acidity of about 1 or less, expressed as pKa value, said solid acid catalyst being essentially nonreactive with the fuel or lubricant prior to combustion and chemically and thermally stable under combustion conditions in the engine.

12 Claims, 9 Drawing Figures

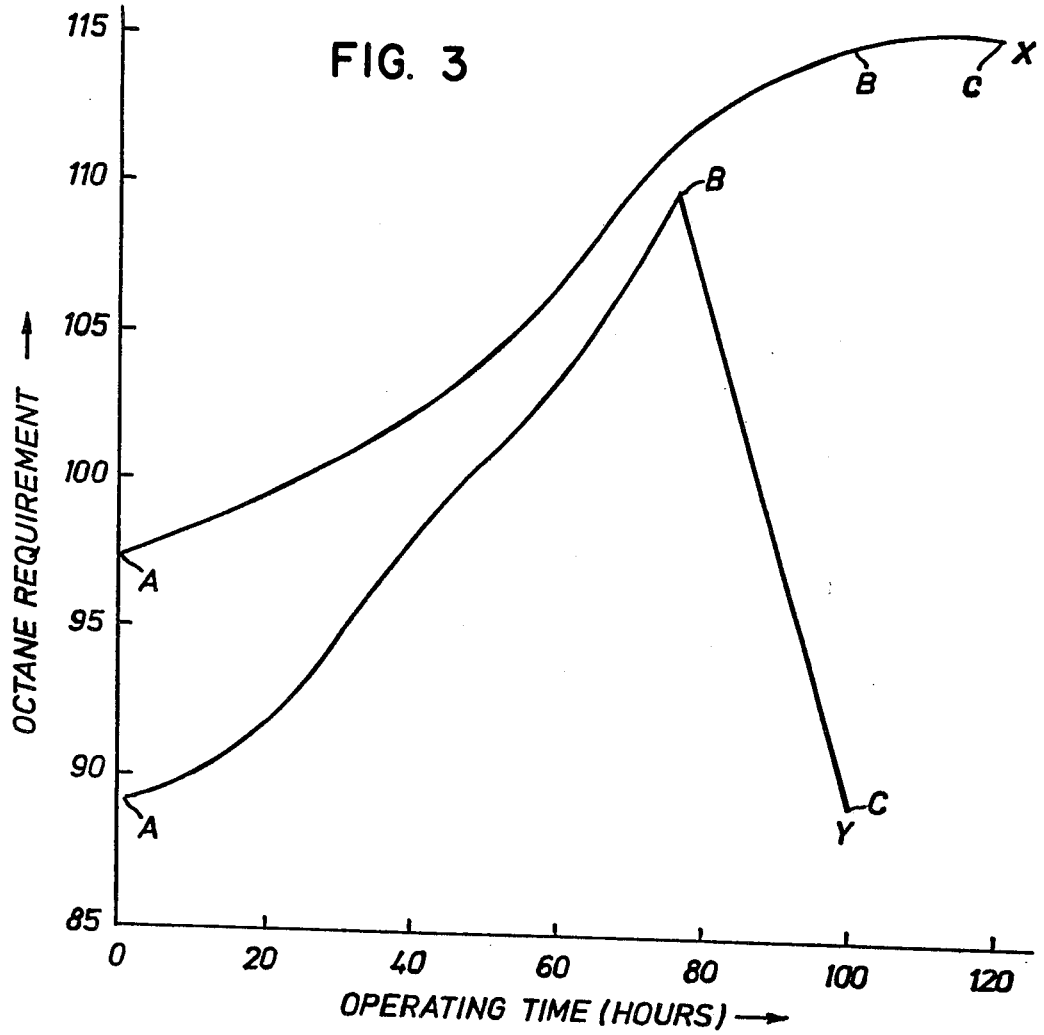
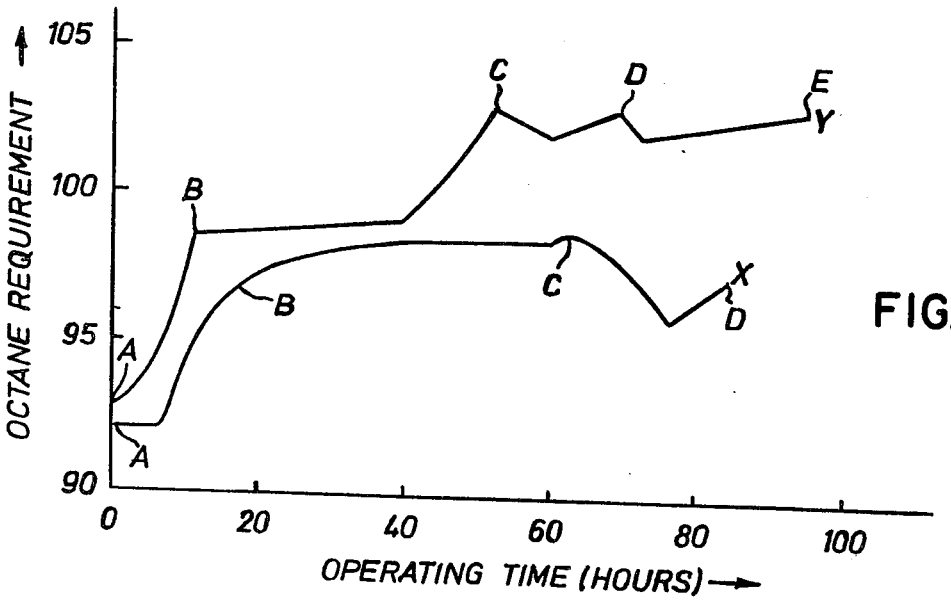
FIG. 4

FUEL AND LUBRICANT COMPOSITIONS FOR INHIBITION OR PREVENTION OF OCTANE REQUIREMENT INCREASE

This is a division of application Ser. No. 614,822, filed Sept. 19, 1975 U.S. Pat. No. 4,092,126.

BACKGROUND OF THE INVENTION

This invention relates to improved hydrocarbon fuels and motor lubricants which prevent or reverse the octane requirement increase (ORI) phenomenon conventionally observed during the initial portion of the operating life of spark-ignition internal combustion engines. More particularly, this invention is directed to novel fuel and lubricant compositions containing a minor amount of a finely divided, high surface area, solid acid catalyst having a critically high non-volatile surface acidity, which exhibit the aforementioned favorable effect on ORI in spark-ignition internal combustion engines, when added with the combustion intake charge to such engines.

The octane requirement increase (ORI) effect exhibited by internal combustion engines operated on gasoline-type fuels is well known in the art. This phenomenon, which may be briefly defined as the demand by a new or clean motor for fuels having increasingly higher octane numbers in order to exhibit knock-free operation, has been traditionally associated with the accumulation of deposits in the combustion chamber during initial operation of such engines. Thus, during the initial operation of a new or clean engine, a gradual increase in octane requirement (OR), i.e., the fuel octane number required for knock-free operation, is observed with an increasing build up of combustion chamber deposits until a rather stable or equilibrium OR level is reached which, in turn, seems to correspond to a point in time where the quantity of deposit accumulation on the chamber wall no longer increases but remains relatively constant. This octane requirement increase is common to all types of spark-ignition engines and often reaches a so-called "equilibrium value" between about 5 and 20,000 miles or corresponding hours of operation. The actual equilibrium value of this increase can vary with engine design and even with individual engines of the same design; however, in almost all cases the increase appears to be significant with ORI values ranging from about 2 to 10 or more research octane numbers (RON) being commonly observed in modern engines.

Several theoretical explanations have been advanced relating the combustion chamber deposit build up to ORI in spark-ignition engines. For example, it has been proposed that the deposit accumulation reduces the combustion chamber volume to a sufficient degree to result in an increase in compression ratio and octane requirements of the engine. Further, it has been suggested that the deposits act as a heat insulator which promotes knocking. Another theory is based on the view that the deposits become incandescent at combustion chamber temperatures causing pre-ignition of the fuel and air charge. In earlier studies of this phenomenon, e.g., see U.S. Pat. Nos. 2,937,932 and 3,126,261, it was postulated that ORI was due to a substantial degree to the use of organolead antiknock agents in gasoline since the thermal decomposition products of these organometallic additives appeared to catalyze ignition of carbonaceous fuel and/or lubricant decomposition products at low temperatures thereby increasing surface ignition in an engine; surface ignition tendencies being indicative of ORI in the engine. More recent studies on the octane requirements of modern automobile engines operated on lead-free gasoline seem to refute this latter theory relating ORI to lead antiknock agents in that unleaded fuel appears to, in fact, give equilibrium or stabilized ORI values which are invariably higher and many times considerably higher than corresponding values with leaded fuels. For example, in a recent reported study of the ORI characteristics of the 1974 Ford production engine families (see Niles et al SAE Paper 740451 "Establishment of ORI Characteristics as a Function of Selected Fuels and Engine Families", February, 1975), the Ford Motor Company established in comparative tests that unleaded fuel gave ORI values which were 1 to 2 RON's higher in some engines and 3 to 4 RON's higher in other engines than leaded fuel, with the stabilized ORI ranging from 6.5 to 11 RON's for unleaded fuel in the engine families tested. In this Ford study, the stabilized octane requirement for the engine families tested almost always approached, if not exceeded, an RON value of 100. A similar worsening of the ORI problem with unleaded fuels in today's automobiles is indicated by a Coordinating Research Council paper entitled "Octane Requirement Increase in 1973 Model Cars (Phase II: 1973 CRC Road Rating Program)" dated February, 1975. In this study involving 102 U.S. cars of the 1973 model year operated on unleaded fuel, the weighted average ORI for 3 different fuel types ranged from 5.4 to 9.0 RON. The lower value, obtained with primary reference fuel (PRF), is reported to be something like 2 octane numbers higher than the PRF value obtained with unleaded fuel in a similar program in 1970–71. In the Ford study and in the CRC study there are indications that more than 12,000 and very likely about 18,000 miles of engine operation are required to reach the stabilized ORI value in most engines. Thus, since the CRC study includes a number of individual tests terminated at or even before the 12,000 mile point, it is possible that the reported average ORI is somewhat below the actual stabilized or equilibrium value.

The implications of the above-mentioned ORI studies with unleaded gasoline are quite significant. Firstly, in view of the large ORI indicated for automobile engine operation with lead-free fuels, it is apparent that the commercially available unleaded 91 RON gasolines, as specified by current governmental regulations, very likely will not provide adequate antiknock performance over the lifetime of today's internal combustion engine designed to operate on lead-free gasoline. This could lead to substantial owner dissatisfaction with automobile antiknock performance in the current and future automobile model years since existing environmental regulations dictate that only unleaded fuel be used in most of the vehicles being produced, i.e., those equipped with catalytic covertors. Thus, these owners won't have the option previously available to switch to leaded regular gasoline having an average RON in the United States of about 93.5 to compensate for the anticipated large ORI; but rather, will have to stay with the commercially available 91 RON unleaded gasoline. Secondly, it is anticipated that the large ORI indicated for lead-free fuel operation will eventually force the production of unleaded gasolines having octane levels significantly above the 91 RON fuel currently produced. The production of an unleaded basestock that would meet these predicted requirements will be an enormous economic and technical task. For example, to manufacture an unleaded gasoline of even 93 RON, in the volume required for the upcoming automobile market, would require expensive blending components and costly changes in refining processes to build up octane-making capability to its highest level in history. Further, from the standpoint of energy conservation, various studies have shown that, in the absence of technological breakthroughs, the production of a lead-free gasoline of 96 RON or greater will expend more energy than is realized in gas economy by having such a fuel available. Thus, if unleaded fuels of 96 RON or greater or eventually required, a significant diversion of crude oil and increase of energy consumption can be projected for the refining phase over present levels of utilization.

From the foregoing it is believed apparent that the advent of unleaded gasoline as a fuel source for spark-ignited internal combustion engines could very likely lead to an accentuation of the ORI phenomenon previously observed with leaded fuels having adverse impact not only on the fuel costs to the consumer but also in the very critical area of energy conservation and self-sufficiency. Consequently, any gasoline composition or method which will eliminate the ORI phenomenon or provide octane requirement reduction (ORR) for both leaded and unleaded fuels in the internal combustion engine would be an exceedingly valuable advance in the art.

DESCRIPTION OF THE PRIOR ART

The enormous economic incentives for minimizing the equilibrium octane requirements of internal combustion engines have led to extensive research efforts in the field. In the gasoline industry, interest has centered mainly on the possibility of an additive that would provide ORR or prevent ORI. The search for ORR additives has gone on for many years with little success. The patent art is replete with disclosures of a variety of materials as potential ORR additives. Although some of these materials are effective for other functions, such as the polyalkenyl succinimide and amine-containing (see, for example, U.S. Pat. Nos. 3,307,928, 3,223,495 and 3,363,999) detergent-dispersant additives, and have thereby reduced deposit formation, none has modified combustion-chamber deposit properties to effect ORI or ORR to the appreciable extent required by commercial market conditions. This apparent lack of success in finding a viable means or method for preventing or reversing ORI in spark-ignited internal combustion engines is evidence by the aforementioned studies by the Ford Motor Company and the Coordinating Research Council, indicating a continuing concern for the ORI problem on the part of the automobile and petroleum refining industries.

SUMMARY OF THE INVENTION

It has now been found that when minor amounts of certain high surface area, finely divided solid acid catalysts of critically high, non-volatile surface acidity are used as gasoline and lubricant oil additives, a significant reduction in ORI is produced. This reduction in ORI can be embodied in the prevention or substantial inhibition of ORI in new or originally clean spark-ignition internal combustion engines in which the deposit equilibrium octane requirement (OR) level has not been reached or, alternatively, can take the form of a reduction in ORI, i.e., OR can be lowered, in a spark-ignition internal combustion engine operated or used to the extent of reaching the deposit equilibrium level inducing ORI.

Accordingly, in its broadest aspects the instant invention is directed to improved hydrocarbon fuels and lubricating oils containing an octane requirement increase-inhibiting amount of a high surface area, refractory solid acid catalyst having;

(a) an average particle size in the range of about 0.01 to about 10 microns, and (b) surface acid centers formed by metallic, hydrocarbon insoluble cations of sufficiently high acidity such that the average non-volatile surface acidity is 1 or less, expressed in pKa units.

The metal-containing, solid acid catalysts of the invention, which preferably comprise refractory metal oxides or halogenated metal oxides having the aforementioned high surface acidity, are essentially non-reactive with the hydrocarbon carrier, i.e., fuel or lubricating oil, prior to exposure to combustion conditions in the engine, and further, exhibit substantial thermal and chemical stability under combustion conditions in the engine.

The novel hydrocarbon fuels and lubricating oils of the invention are quite effective in preventing or reversing ORI in spark-ignition, internal combustion engines which are, or have been, operated on either lead-free or leaded hydrocarbon fuels. This prevention or reduction in ORI is believed to be achieved by a modification in the chemical nature of the deposit laid down on the combustion zone wall during and/or prior to the time the fuel and/or lubricant compositions of the invention are introduced with the combustion intake charge to the spark-ignited internal combustion engine. While the exact nature of the chemical charge which occurs in the combustion zone deposit has not been established, it appears from gravimetric and elemental analyses of deposits in internal combustion engines operated with compositions according to the invention that a portion of the solid acid catalyst, e.g., 1 to 50% of that introduced into the combustion zone, incorporates into the matrix formed by the deposit with little or no simultaneous reduction in the overall quantity of deposit. Accordingly, another aspect of the instant invention relates to an improved method of operating a spark-ignition internal combustion engine characterized by introducing with the combustion intake charge, an octane requirement increase-inhibiting amount of a high surface area, refractory solid acid catalyst having, (a) an average particle size in the range of about 0.01 to about 10 microns, and (b) surface acid centers formed by metallic, hydrocarbon insoluble cations of sufficiently high acidity such that the average non-volatile surface acidity is 1 or less, expressed in pKa units.

DESCRIPTION OF THE PREFERRED EMBODIMENTS

Figure 1:
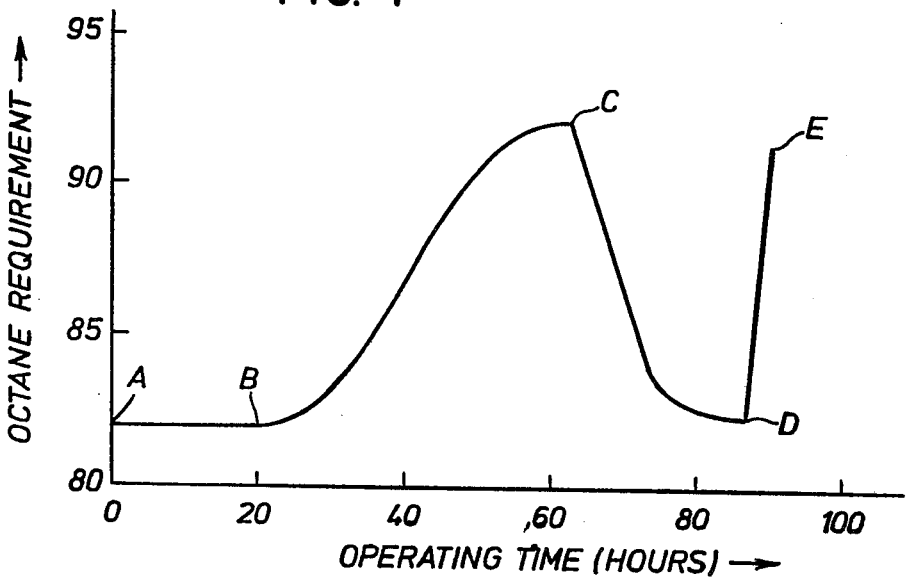

The solid acid catalyst components, which exhibit the unique ORI inhibiting effects in the fuel and lubricant compositions of the instant invention, are characterized in particular by their critically high, non-volatile surface acidity as measured by conventional absorbed acid-base indicators in non-polar organic solvents such as benzene and isooctane. The chemical nature of such solid acids and various methods employing a series of absorbed indicators, known as Hammett indicators, to measure the acid strength and acid strength distribution of surface acid centers on such solids are conventional, having been described previously in a variety of references in the open literature, e.g., see Johnson O., J. Phys. Chem 59, 827 (1955); Benesi H. A., J. Am. Chem. Soc., 78, 5490 (1956); Benesi H. A., J. Phys. Chem. 61, 970 (1957); and Hirschler A. E. and Schneider A., J. of Chem. and Eng. Data 6, No. 2, 313 (1961). In general, these solid acid catalysts are refractory, high surface area, metal-containing solids having surface non-volatile acidity or proton donating ability concentrated in a multiplicity of acid centers distributed over the solid surface. These acid centers, which are formed by metallic, hydrocarbon insoluble cations bound in the matrix of the solid surface, are essentially non-volatile and non-mobile in the compositions of the invention due to the refractory, insoluble nature of the solid. However, as has been reported in the aforementioned literature references, the acid strength of individual acid centers on the solid surface can and does vary somewhat from relatively weak acids, e.g., pKa's of 3 or higher, to extremely strong acids, e.g., pKa's of −8.2 or less. According to the invention, it is critical that the acid strength distribution of acid centers on the solid surface be such that the average non-volatile surface acidity is 1 or less, expressed in pKa units. When the average, non-volatile acid strength is less acidic than this critical value, i.e., the pKa value is greater than about 1, as is the case with some solid compositions still considered to be acidic in nature, e.g., certain silica-magnesias, fuel or lubricant compositions containing such acid solids become inactive in affecting octane requirement in that ORI reaches the approximate level of that of the base motor fuel. Other solids of low surface acid strength may even increase the ORI equilibrium level over that of the base motor fuel by simply increasing the amount of combustion chamber deposit. While a critical limit exists for the minimum average surface acidity of the solid acid catalysts of the invention, i.e., pKa of 1 or less, it does not appear that any critical maximum surface acidity value exists beyond which such solid acid catalysts become too acid to effect the desired inhibition of ORI in spark-ignition internal combustion engines. As a practical matter, it is impossible to specify with certainty any acid strength greater than a pKa of −8.3 since this value seems to be the acid measuring limit of conventional Hammett indicators (see references above). For certain gasoline types, i.e., those which are rich in olefins (unsaturates) it is desirable to limit the acid strength of the solid catalyst to a maximum average surface acidity value of about −5, expressed as pKa units, in order to avoid possible acid catalyzed polymerization reactions of the unsaturated components. This polymerization can coat the surfaces of the solid acid catalysts thus favoring their agglomerization and settling out from the gasoline carrier, as well as possible deactivation of active ORI inhibiting sites on the catalyst when it is introduced with the intake charge to the engine. While this polymerization phenomenon should not be a problem if substantially olefin-free gasolines are employed or if the solid acid is added via the lubricating oil, it is generally preferred that the average non-volatile surface acidity of the solid acid catalyst be limited to a pKa value between about 1 and −5 to maximize its utility with all gasoline types.

The specific classes of metal-containing, solid acid catalysts which possess the aforedescribed critically high, average, non-volatile surface acidity are well known in the art, having been employed previously in a variety of acid catalyzed processes such as catalytic cracking, polymerization, alcohol dehydration and dimerization. Suitable metal-containing solid acid catalysts include refractory metal oxides having the aforementioned high surface acidity such as binary oxides of aluminum, zirconium, titanium and iron with silicon and halogenated metal oxides such as aluminum oxide. Other metal-containing acidic agents having utility in the compositions of the invention encompass a variety of binary metal oxides having highly acidic properties such as those listed in Tanabe K. et al, Bull. of the Chem. Soc. of Japan 47, 1064 (1974), acid clays and acidic ion exchange resins. Since water is known to have a neutralizing effect on surface acid centers in many of the aforementioned solids, it is preferable to maintain the catalytic agents in a dried, substantially anhydrous state prior to use in the compositions according to the invention. In some cases, this sensitivity to water can be used to advantage to selectively reduce the acidity of very strong acid solids, e.g., certain silica-aluminas, by partial hydration of strong acid sites to form weaker acids before the solid acid catalyst is added to the fuel or lubricant carrier. In fact certain acid catalysts of the invention, e.g., silica-aluminas and halogenated aluminas, appear to be more active when dried at temperatures in the range of about 120° to about 160° C. over the same catalysts calcined at 500°–600° C. In these cases, the acidity of the partially hydrated acid solid can be conveniently determined by amine titration with the appropriate Hammett indicators (see references cited above) prior to its use. For reasons relating to availability and cost-effectiveness, it is preferred that the solid acid catalyst utilized in the instant invention be selected from the class consisting of binary oxides of silicon and aluminum, i.e., silica-aluminas, and halogenated aluminum oxides, i.e., chlorinated or fluorinated aluminas. In this regard, it is most preferred that the solid acid catalyst be silica-alumina with a silica-to-alumina weight ratio of from 0.1 to 500 ($SiO_2/Al_2O_3$) or a fluorinated alumina containing up to 10% by weight fluorine. For optimum effectiveness as ORI inhibiting agents in the compositions of the invention, it is also essential that the solid acid catalysts possess high surface areas. Suitably, this surface area of the finely divided solid acid in the fuel or lubricant intake charge is at least 100 $m^2/g$. with surface areas in the range of 100 to 700 $m^2/g$ being preferred. Such high surface areas are characteristic of the aforedefined solid acid catalyst compositions of the invention.

All of the aforementioned solid acid catalysts, including those specifically preferred, are considered to be refractory in nature within the context of the instant invention in that they possess sufficient thermal and chemical stability to exist for a finite period of time as solids having surface acidity, after being exposed to the conditions present in the combustion chamber of the typical spark-ignition internal combustion engine. As a general matter, this requires that the surface acidity as represented by the chemically combined, ionizable metallic cations on the solid surface be thermally stable at temperatures in the range of 200° to 800° C. and chemically stable in the presence of water vapor at the same temperature range. In this regard, thermal and chemical stability, characterized previously as substantial stability, is taken to mean that the decomposition temperature is not so low, nor the hydrolysis reaction rate so fast, that the acidic solids cannot be deposited intact on the combustion chamber walls and exist for a time period sufficient to provide the desired inhibition of ORI. Furthermore, as indicated above, the solid acid catalysts are essentially non-reactive with the hydrocarbon fuel or lubricant carrier prior to its introduction into the engine combustion zone. This inert nature of the solid acid catalyst in the compositions of the invention is primarily due to the inherent immobility of the acid centers on the catalyst surface, being non-volatile and hydrocarbon insoluble, although acid strength is also a factor in certain limited instances, e.g., polymerization of olefin-rich gasolines, discussed above. According to the invention, it is desirable that the non-reactivity of the solid acid catalyst in the hydrocarbon fuel of lubricant carrier include all conditions which may be encountered on a practical scale in the refining and marketing chain prior to its introduction of the catalyst plus hydrocarbon carrier as part or all of the intake charge to spark-ignition, internal combustion engines. Essential non-reactivity under such conditions, which may include temperatures of up to 200° C., is amply satisfied by the aforedefined solid acid catalysts according to the invention.

A second factor which is especially critical to the achieving of ORI inhibition with the hydrocarbon fuel and lubricant compositions of the invention is the particle size of the solid acid catalyst in the compositions. In this regard, it is essential that the solid acid catalyst be subdivided to an average particle size in the range of about 0.01 to about 10 microns for incorporation into the fuel and lubricant compositions of the invention. With solid acid particle sizes below the critical minimum limit, a rapid loss of ORI inhibiting effect is observed, ultimately approaching ORI obtained with the base fuel or lubricant without the solid acid additive. While the reasons for this loss in activity has not been established with certainty, it seems that this minimum limit on particle size is necessary to insure that the solid acidic component functions as a particulate solid rather than a vapor during the combustion cycle when fuel and/or lubricant is carried into the combustion chamber and vaporized or otherwise decomposed. That is, it appears that the unique effects of the instant compositions in preventing or reversing ORI are somehow tied to the incorporation of the solid acidic component onto the combustion chamber wall or deposit, and as such, the acidic component must act as a solid during the combustion cycle to allow it to impinge upon and adhere to the combustion zone wall rather than being swept completely out of the combustion chamber with the exhaust vapors. This minimum particle size limit of 0.01 microns insures that a sufficient number of solid acid particles will remain in the combustion chamber to give the desired inhibition of ORI. While the upper limit on particle size is governed to a lesser degree by an inherent lack of activity in the combustion chamber, it is also important since at particle sizes above about 10 microns, it becomes increasingly difficult to ensure uniform dispersion of the acidic agent in the carrier and proper transport of the acidic agent into the combustion zone. Other problems related to proper operation and maintenance of the internal combustion engine, e.g., erosion of engine parts, also dictate that the solid acid catalyst average particle size not exceed 10 microns. The optimum particle size of the solid acid catalyst in compositions according to the invention is governed to a certain degree by the type of carrier employed. Thus, for gasoline or hydrocarbon fuel compositions, it is preferred that the solid acid catalyst average particle size range from about 0.1 to about 5 microns, whereas in the more viscous lubricant compositions of the invention it is preferable to employ average particle sizes in the range of 0.5 to 5 microns.

In the operation of a spark-ignition internal combustion engine to inhibit ORI according to the method of the invention, it is possible to introduce the solid catalytic agent using techniques other than incorporation into the fuel or lubricant intake charge. Thus, the solid acid catalyst can be injected directly, with or without a liquid hydrocarbon carrier, into the intake manifold of the engine. Similarly, the acidic component can be metered as a concentrate, in a hydrocarbon carrier, into the fuel intake line to the engine or even be added as a slowly dispersing, sustained release solid concentrate to the fuel tank. Perferably, the method according to the invention is carried out by introducing with the combustion intake charge, a hydrocarbon fuel or lubricant composition containing the solid acid catalyst component of the invention. In this preferred aspect, the solid acid catalyst is added directly to gasoline or lubricating oil in the manner of conventional gasoline or lube additives or as a concentrate in hydrocarbon carrier which is tank mixed with the gasoline or lubricating oil prior to use. When the solid acidic component is added as an additional agent to a crankcase oil or lubricating motor oil, the acidic component ultimately is conducted to the gasoline and to the walls of the combustion chamber via the lubricating oil film from the ring-swept area of the cylinder where it becomes admixed with gasoline.

The solid acid catalysts of the invention are effective ORI inhibiting agents in hydrocarbon fuels and lubricating oils in total quantities which generally comprise only a very minor amount of the fuel or lubricant composition. While the specific concentration of solid acid catalyst employed to obtain the desired ORI inhibiting effect is dependent on a variety of factors such as the introducing media employed, i.e., fuel or lubricating oil, the surface area of the solid acid, its acid strength and particle size, etc.; it can be generally stated that the concentration range of solid acid catalyst is established by that which produces a concentration sufficient to yield about 0.1 to 500 mg of acid catalyst in the combustion chamber. Accordingly, considerably higher concentrations of this acid catalyst in the introducing media are required when it is introduced in the crankcase lubricating oil. Acid catalyst in the range of about 0.003 to 15 grams per quart of motor oil is a useful amount sufficient to produce the above-mentioned weight range of acid catalyst per gallon of gasoline in the combustion chamber. For the preferred solid acid catalysts of the invention, such as silica-alumina, which possess a large number of acid centers of high acidity pKa's of $-8.3$ or less, it is generally preferred that the concentration of solid acid catalyst in the gasoline intake charge not exceed about 400 mg per gallon, with concentrations in the range of about 1 to about 250 mg per gallon being most preferred.

The hydrocarbon fuel employed in the solid acid catalyst-containing compositions of the invention is suitably any conventional gasoline formulation consisting mainly of hydrocarbons, including both unleaded and leaded varieties. As is well known in the art, gasoline can be generally defined as a mixture of hydrocarbons of various boiling points, having a boiling range determined according to ASTM Method D-86 of between about 20° and 230° C. A suitable gasoline typically contains from about 0 to about 30% by volume olefins, from about 5 to about 55% (preferably, from about 10 to about 45%) by volume aromatics, with the remainder being saturated hydrocarbons. As indicated above, useful gasoline based fuels according to the invention may also contain minor amounts of organolead antiknock agents i.e. tetraalkyllead, as well as other organo-metallic additives such as manganese derivatives which are useful for the same purpose. In such cases, minor amounts of halogen scavenger such as ethylene dibromide and dichloride may also be present. Preferably, the gasoline employed in the fuel compositions of the invention is essentially free of organolead and other metallic antiknock agents. Both the leaded and unleaded gasoline compositions of the invention may contain other conventional additives such as dyes, spark plug anti-foulants, oxidation inhibitors, detergent-dispersants and metal deactivators.

The lubricating oils to which the solid acid catalyst, ORI inhibiting agents of the invention are added include any conventional synthetic or mineral oil-based lubricating oil. Preferably, the lubricating oil is mineral oil. Suitable mineral oil compositions include any normal or commercial fully formulated motor oil such as those comprised of a paraffin base, naphthene base, mixed paraffin-napthene base distillate and residual oils. Lubricating oils having an SUS viscosity at 100° F. between about 50 and 1000 may be used. These lubricating oils will typically contain a variety of conventional additives such as detergents and dispersants.

The hydrocarbon fuel and lubricating oil compositions of the invention are heterogeneous dispersions or suspensions wherein the solid acid catalyst agent in finely divided form is dispersed or suspended in the base liquid carrier. These heterogeneous compositions can be prepared in any conventional manner employed previously for dispersing insoluble solids in liquid carriers. For example, the finely-divided acid catalyst may be produced from chemical entities of larger particle size by known communition techniques such as the use of a micronizer and the like. At the desired range of particle size, the solid acid may then be conveniently dispersed or suspended in the desired liquid media, i..e., motor fuel or lubricating oil, to give stable dispersions or suspensions by use of ultrasonic or other known mixing techniques. To aid in the initial dispersion and to promote the ultimate stability of the final suspension, it is desirable to employ one or more conventional surface active agents including acidic, amphoteric and neutral or nonionic materials. Any preparation technique employed should preferably be carried out under substantially anhydrous conditions to avoid the deactivating effects of water on the acid centers present on the surface of the solid acid catalyst used.

Preparation of hydrocarbon fuel and lubricant compositions according to the invention and their use in inhibiting the ORI phenomenon in spark-ignition internal combustion engines will be further described with reference to the following illustrative embodiments and associated figures, which are not to be construed as limiting on the invention.

ILLUSTRATIVE EMBODIMENT I

A test program was carried out using a single cylinder CFR engine to demonstrate both the ORI inhibiting effect in a clean engine and the reversal of ORI effect (octane requirement reduction or ORR) in an engine having accumulated combustion chamber deposits with a gasoline composition according to the invention.

The solid acid catalyst composition employed in this test was an Omega zeolite (12.5% $Al_2O_3$/87.5% $SiO_2$) having an average surface acidity of about −5.6 pKa, pore volume of 0.2 cc/g, surface area of about 500 $m^2/g$ and an average particle diameter of about 1 micron achieved by grinding with a Sturtevant 2" laboratory micronizer. To obtain a gasoline composition according to the invention this subdivided, solid acid catalyst was suspended in an unleaded gasoline in the amount of about 50 mg/gallon utilizing an ultrasonic agitator. The base gasoline employed was a heavy catalytically cracked fraction-rich fuel containing about 38% by volume aromatics, about 1% by volume olefins and about 61% by volume of saturates. This base fuel had an initial boiling point of 34° C., a 50% boiling point of 101° C. and a final boiling point of 207° C. by ASTM distillation method D-86.

To determine the effect of the gasoline composition according to the invention, the CFR engine (modified by the addition of a Tillotson Carburetor ahead of the CFR carburetor) was operated under accelerated deposit accumulation conditions for an approximate test period of 100 hours using both the gasoline composition of the invention and the unleaded base fuel intermittently through the test. These test fuels were charged to the engine via an electric fuel pump from nitrogen-blanketed storage tanks thereby permitting continuous operation. For engine lubricating, a 400 MVI basestock with no additives was used to limit the number of test variables.

The operating and rating procedure used in the test involved setting the motored compression pressure on a clean, warmed-up engine to 192 psig by varying the cylinder height. The mirometer reading was then set at 0.352 inch with appropriate corrections for ambient conditions as per ASTM Compression Ratio Method. The engine was fired on base fuel with ignition set for 13° BTDC (Before Top Dead Center). The air/fuel ratio was set for maximum knock, and the head height was adjusted to trace knock utilizing a knock meter. The head height reading was converted to KLCR (knock limited compression ratio) using ASTM tables on the method. The engine was allowed to run at an ignition setting of 5° ATDC in order to accumulate deposits and ORI. It was periodically rated by returning the ignition setting to 13° BTDC and proceeding as described above. This KLCR method allows rating of the engine to be carried out rapidly and without changing fuel. The relationship between KLCR and octane requirement increase due to deposit formation can be obtained by running the engine on base fuel and periodically comparing the KLCR as determined above with the PRF requirement determined at constant compression ratio.

A summary of the test results, including a designation of the operating periods with each test fuel are given in FIG. I. In this figure, which plots operating time versus engine octane requirement, the engine performance line is segregated into line segments by points A–E to indicate engine operation with the gasoline containing the solid acidic additive according to the invention (line segments A–B and C–D) and operation with the base gasoline (line segments B–C and D–E). The observed OR for the first 20 hours of operation (segment A–B) illustrates the prevention or substantial inhibition of ORI with a fuel composition according to the invention. In contrast, the recorded OR measurements for line segments B–C and D–E indicate substantial ORI where the engine was operated on base fuel. The OR results recorded beginning at point C and extending along line segment C–D show a reduction of octane requirement (ORR effect) during the 60 to 90 hour test period with the gasoline composition according to the invention after OR had been allowed to increase to a rather high level (during line segment B–C operation) with the base fuel.

ILLUSTRATIVE EMBODIMENT II

Figure 2:
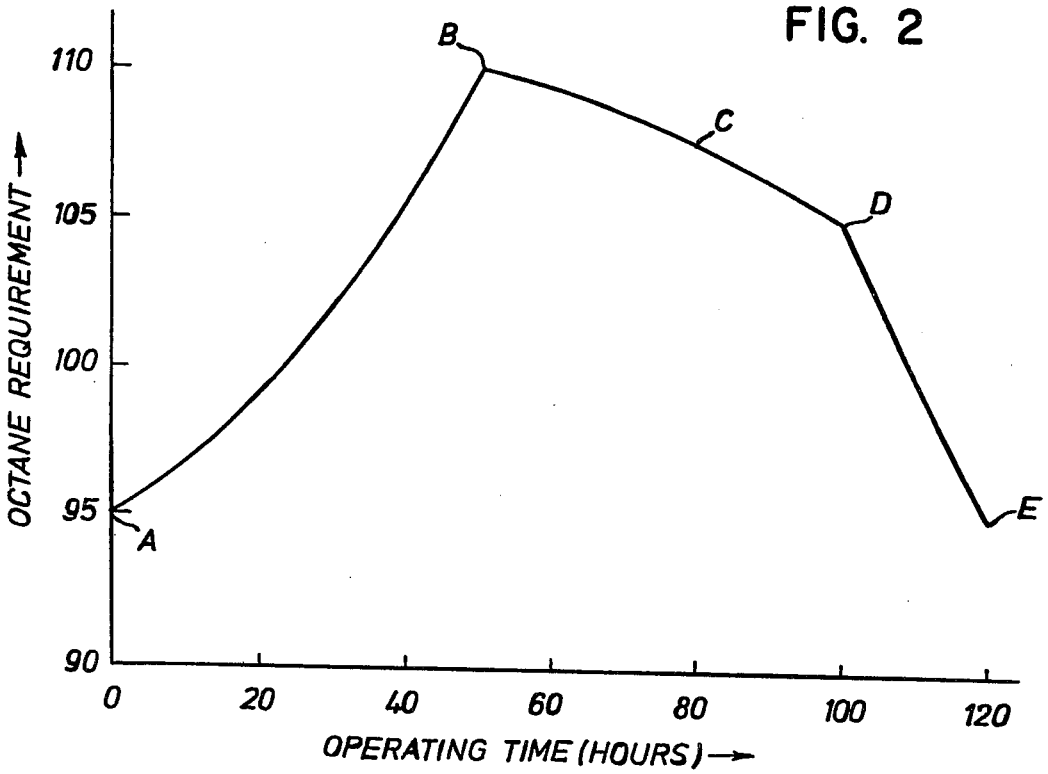

Utilizing the procedure described in Illustrative Embodiment I, a test was carried out with a CFR single-cylinder engine to demonstrate the relationship of acid strength (average surface acidity of the solid acid catalyst additive) to inhibition of ORI. In this test, which was carried out over an operating period of about 120 hours, the test cycle consisted of an initial operating period with unleaded base fuel to establish an ORI effect followed by consecutive operating periods with the base fuel containing 50 mg/gallon of $Al_2O_3$ (pKa of greater than 3.3) and the same $Al_2O_3$ base modified by the incorporation of about 0.7%/w Cl to give it an average surface pKa of less than 1. Both test additives were employed in an average particle size of 2 microns and other properties were essentially the same, e.g., surface areas of about 328 $m^2/g$ and pore volume of 0.46cc/g. The rating procedure described in Illustrative Embodiment I was utilized in test. The results of this test are shown graphically in FIG. 2 which plots operating time versus engine OR in a manner similar to FIG. 1. In this FIG. 2, line segment A–B represents initial operation with the unleaded base fuel, line segment B–C shows operation with the $Al_2O_3$ containing fuel, line segment C–D represents a return to base fuel and line segment D–E shows operation with the fuel containing $Al_2O_3$ + 0.7%/w Cl. As can be seen from the figure, pure $Al_2O_3$ had only a slight, if any, effect in reversing the ORI obtained with base fuel while $Al_2O_3$ containing 0.7%/w Cl had a marked ORR effect.

ILLUSTRATIVE EMBODIMENT III

A series of tests were performed with a CFR single-cylinder engine according to the procedure described in Illustrative Embodiment I to demonstrate the effect of solid additive acidity, imparted by fluoriding $Al_2O_3$, on the OR response of the engine. In this embodiment a first test cycle was carried out using unleaded base fuel and base fuel containing pure $AL_2O_3$ (pKa of greater than 3.3) subdivided to an average particle size of about 1.25 microns. In the second test cycle the fuel source consisted of unleaded base fuel and base fuel containing $Al_2O_3$ modified by the incorporation of 1%/w F (pKa of less than 1) at the same average particle size. In both tests, the concentration of solid additive was 50 mg/gal and the pore volumes and surface areas were 0.51 cc/g and about 180 $m^2/g$, respectively. The rating procedure of Illustrative Embodiment I was used in this test program. The results of these tests are given in FIG. 3, wherein curve X represents the change in OR with operating time for unleaded base fuel and base fuel containing $Al_2O_3$ and curve Y represents similar results obtained with base fuel and base fuel cntaning $Al_2O_3$/1% F. In both curves, line segments A–B represent initial operation with unleaded base fuel while line segments B–C represent operation with the fuel containing solid additive. As can be seen from the figure, dramatically increased ORR activity is imparted to the $Al_2O_3$ by the addition of 1%/w F.

ILLUSTRATIVE EMBODIMENT IV

Again, using the procedure described in Illustrative Embodiment I, a series of tests were carried out with a CFR single-cylinder engine to demonstrate the combined effects of particle size and surface acidity on OR response in the engine. In this embodiment, two test cycles were conducted using unleaded base fuel, and base fuel containing $A1_2O_3$ incorporated with 1%/w F (pKa less than 1) at 50 mg/gal with the main difference in the test cycles being that the average particle size of the solid additive in the first cycle was about 1.5 microns and the particle size in the second cycle was about 1 micron. In both cases, the solid additive had a pore volume of 0.51 cc/g and a surface area of about 180 $m^2/g$. The rating procedure of Illustrative Embodiment I was employed in the test program. The results of these tests are given in FIG. 4 wherein curve X represents the change in OR with operating time for unleaded base fuel and the base fuel containing the larger particle size additive and curve Y represents similar results obtained with the smaller particle size additive. Both curves are segregated according to fuel utilization with segment A–B indicating operation with unleaded base fuel plus additive, segment B–C showing operation with unleaded base fuel alone and segment C–D showing a return to base fuel plus additive, with a forth segment (D–E) in the case of curve Y showing final operation with base fuel alone. From the results given in the figure, it is apparent that the larger particle size additive gave a somewhat greater ORR effect than the smaller particle size additive.

ILLUSTRATIVE EMBODIMENT V

Figure 5:
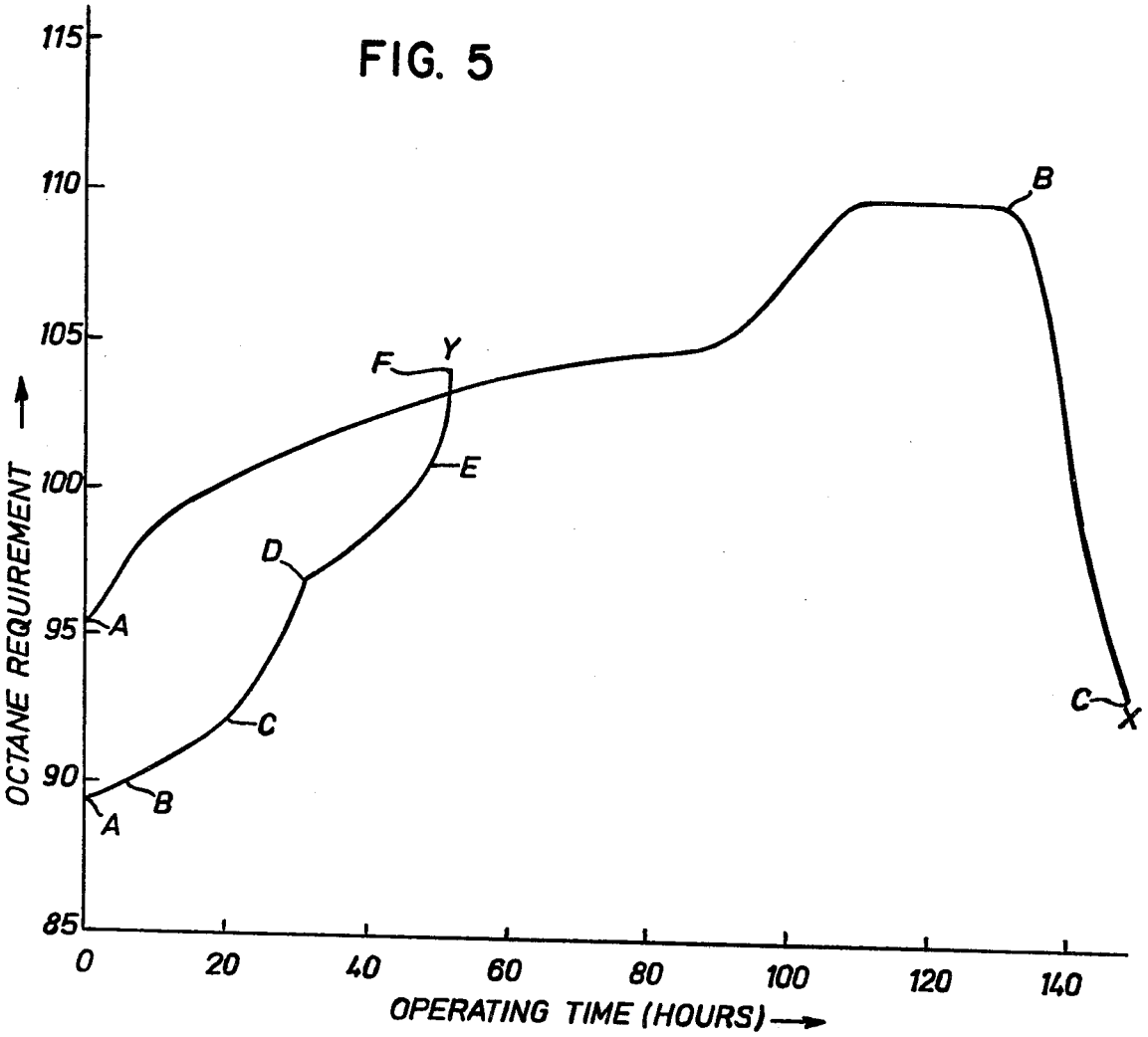

In this series of CFR single-cylinder tests, carried out according to the procedure described in Illustrative Embodiment I, an attempt was made to define the effect on OR of higher concentrations of a solid acidic additive according to the invention. In these tests, both the unleaded base fuel and base fuel containing 250 mg/gal of uncalcined, amphorous $A1_2O_3$ (29%)/$SiO_2$ (67%) plus 10% faujasitic zeolite (Davison DZ-5 cracking catalyst) were employed in test regimes designed to establish either the ORR effects of the additive or its ORI inhibiting properties. This additive, which has an average surface acid strength of pKa less than −3.0, pore volume of 0.60 cc/g and surface area of about 360 $m^2/g$, was dispersed in the base fuel at an average particle size of 1.6 microns. The rating procedure of Illustrative Embodiment I was utilized in this test. In the first test cycle examined, one engine was operated on base fuel without additive to establish a stabilized ORI followed by operation with additive-containing fuel for a time period sufficient to determine the nature and extent of any ORR effect. The results from this test cycle are recorded as curve X in FIG. 5 with the curve segment A–B indicating operation on base fuel without additive and curve segment B–C indicating OR response with the additive containing fuel. In the second test cycle examined, the order of fuel utilization was reversed so that the additive-containing fuel was employed in the initial operating period followed by base fuel alone, with the cycle being repeated 1½ times, finishing with additive-containing fuel. The results from this test cycle are recorded as curve Y in FIG. 5 with curve segments A–B, C–D and E–F depicting OR response with additive-containing fuel and curve segments B–C and D–E indicating OR response with base fuel alone. From the results of this test, as recorded in FIG. 5, it is apparent that concentrations of the acidic additive tested, at up to 250 mg/gal, give large ORR effects in engines allowed to reach a stabilized ORI on base fuel alone, whereas initial operation of the clean engine on additive-containing fueld seems to approach additive-free fuel operation, at least under the limited test conditions employed.

ILLUSTRATIVE EMBODIMENT VI

In additional CFR single-cylinder tests carried out according to the procedure described in Illustrative Embodiment I, the following finely-divided solid additives at average particle sizes in the ranges of 2 to 3 microns were tested in unleaded base fuel at a concentration of from about 25 to 50 mg/gal and found to be inactive or pro-ORI.

| Solid Additive | Average Surface pKa |
|---|---|
| $MgO/SiO_2$ (26% MgO) | greater than +1 |
| 97.2% MgO/2% CaO | greater than +6.8 |
| 0.1% Pt on $SiO_2$ | greater than +4.0 |
| 10% CuO on $Al_2O_3$ | greater than +6.8 |
| Silica Gel (99.9% $SiO_2$) | greater than +4.0 |
| Calcined Pseudo-boehmite[a] with 0.7% Cl | less than −8.3 |
| Oxalic Acid[b] | less than −5.6 |

[a]became discolored due to reaction with gasoline components
[b]decomposes at 186° C.

ILLUSTRATIVE EMBODIMENT VII

To establish the effect of gasoline compositions according to the invention on the OR requirements of multicylinder engines, a series of tests were carried out using a 1971 Ford 351 CID-2V (Cleveland version), dynamometer-mounted engine. In the test program employed, a standardized, low-speed driving cycle (idle to 40 mph or 750 to 1500 rpm over a 30 second interval) was used for all operation. Accelerations and decelerations accounted for about 70% of the cycle period, and operation with manifold depression (vacuum) greater than 15 in. Hg or less than 10 in. Hg accounted for 40% of the period. The fuel consumption rates averaged 2 to 3 gal/hr with this 0–40 cycle. In this respect, the cycle was equivalent to a typical urban driving cycle of 30 mph average at 12 miles per gallon. In order to permit "top gear" accelerations from idle, the inertia loading of the shaft (179 lb-ft$^2$ moment flywheel) simulated only about half of the calculated vehicle inertia. Engine loading from exhaust back-pressure was not controlled, and manifold pressure was one half or less of that expected in a vehicle installation. Engine fans, belt driven compressors and auxillary pumps, and accessory electrical loads were not employed; however, the standard fuel, water, and oil pump, and generators were driven by the engines. The shaft load applied by the dynamometer during transience was not programmable, but it was determined by the transient response (inductive, speed-dependent) of the dynamometer to a step change in excitation (or field) current. Other measures were taken for convenience, efficiency and increased ORI severity such as the elimination of vacuum activated spark advance units and engine oil filters. The ignition system and spark timing were set per the manufacturer's specifications. Other standard test conditions, maintenance and measurements may be summarized as follows:

Engine Coolant: 20%v Glycol in water

Coolant Temperature: 190°–195° F., engine thermostat

Oil Supply Temperature: 200° ± 20° F., externally cooled measured at return line from cooler to sump.

Start of Each Test: Replace cylinder head assemblies, clean piston crowns and cylinder piston-clearance areas, overhaul distributor, replace spark plugs and replace parts as necessary; set ignition, idle speed, idle and mixture to manufacturer's specifications.

Break-in Period: 4–8 hours on test cycle.

Allowable During Test: Replace fouled spark plugs and faulty ignition components with timing, idle speed reset to start-of-test values, octane requirement measured before and after.

Oil, Coolant Addition: As necessary.

Spark Timing: Check every 100 hours, maintain total timing ± 2° BTC at 2000 rpm.

Octane Requirement Determinations: Start of test, and at 25–50 hour intervals thereafter.

Octane requirement determinations were conducted at 2,000 rpm, wide-open throttle (WOT), constant speed conditions using Primary Reference Fuel (PRF) rating methods. Specifically, the following steps were followed in engine rating:

(a) Stabilization — the engine was stabilized at the specific cycle conditions for oil and coolant temperatures.

(b) The test fuel supply was removed and the engine allowed to run out of fuel (without stall) prior to running a reference fuel. This measure, also conducted between successive PRF fuels, allowed flushing the previous fuel from the fuel system.

(c) Approach to rating condition — The throttle was opened until the engine speed reached 2,000 rpm; while 2,000 rpm was maintained with throttle, load was applied until the WOT condition was reached (load-approach).

(d) Rating Condition: the PRF octane requirement was defined as the octane number of the PRF fuel which caused trace-audible-knock (by judgment of the engine operator) at a constant speed of 2,000 rpm, at the time WOT was reached, or before any increase in coolant outlet temperature could be detected.

Figure 6:
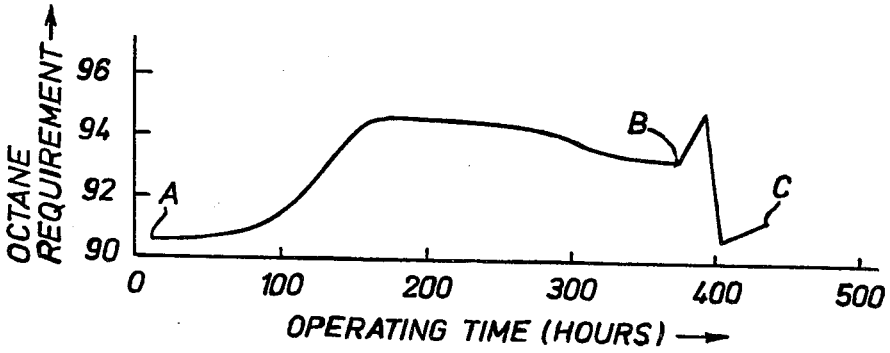
Figure 7:
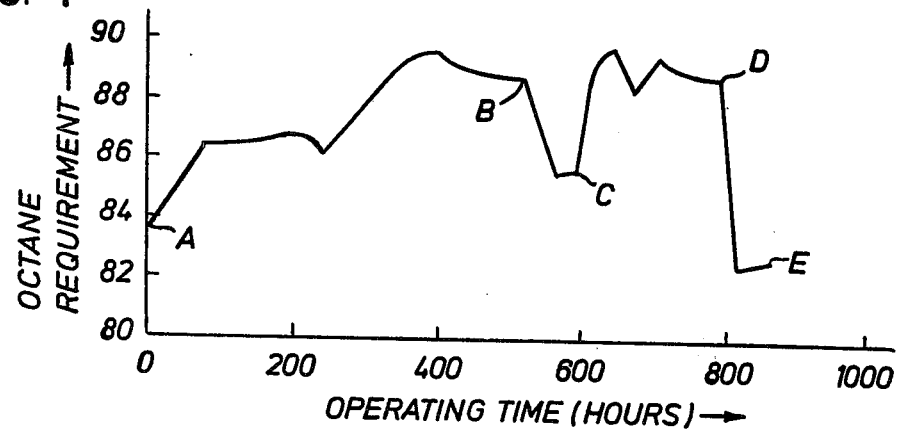

In the test series of this embodiment, reported graphically in FIGS. 6 and 7, the same unleaded base fuel and acidic additive was employed; the tests being distinguishable by the use of different lubricating oils. The base gasoline employed was a full-boiling range, non-leaded gasoline rich in catalytic reformate and crackate containing about 38% by volume aromatics, about 1% by volume olefins and about 61% saturates. This base fuel had an initial boiling point of 34° C. and a final boiling point of 207° C. by ASTM distillation method D-86. The solid acid catalyst additive employed in this test series was the uncalcined amorphous $Al_2O_3$ (29%)/$SiO_2$ (67%) plus 10% faujasitic zeolite additive of Illustrative Embodiment V (Davison DZ-5 Cracking Catalyst). For this test series, the additive was ground to an average particle size of 2.5 microns and suspended in the base fuel at a concentration of about 50 mg/gal. In the test cycle reported in FIG. 6, an ashless (sulfur and phosphorus-containing) motor oil was used, while in the test cycle depicted in FIG. 7, the motor oil employed was a fully-formulated commercial oil (Shell X-100$^R$ 10w/40 Multigrade motor oil). The oils employed were changed out periodically throughout the tests, usually about every 300 hours, during periods of stabilized octane requirement. The test engine followed in each case was an initial operating period with unleaded base fuel alone to establish a stabilized ORI followed by an operating period with the additive-containing fuel for a time period sufficient to determine the nature and extent of any ORR effect. In the second test cycle (FIG. 7) with fully-formulated motor oil, the operating sequence was repeated a second time following the first operating period with the additive-containing fuel. During periods of operation with fuel containing solid additive, a dispersion of the solid particles in gasoline was maintained by operating an ultrasonic transducer suspended in the fuel supply tank.

The results of the two test programs are reported as plots of operating time versus engine octane requirement in FIGS. 6 and 7, with each operating curve being segregated into line segments based on fuel utilization. Specifically, in FIG. 6, line segment A–B indicates operation with unleaded base fuel alone, whereas line segment B–C depicts operation with additive-containing fuel. In this same respect, in FIG. 7, line segments A–B and C–D indicate operation with unleaded base fuel alone while line segments B–C and D–E show operation with additive-containing fuel. From the results recorded in the figures, it is apparent that the fuel compositions according to the invention give a rapid and dramatic ORR effect which is independent of the type of motor oil employed (ashless oil in FIG. 6 and fully-formulated oil in FIG. 7). In fact, it appears that the ORR effect obtained is of sufficient magnitude that it approaches, if not exceeds, the OR of the clean engines.

Additional confirming tests were also performed with 1971 Ford 351 CID-2V engines using the procedure and fuel compositions described above. In a total of 6 test cycles the Ford engines exhibited ORR 4 times and were stable twice.

ILLUSTRATIVE EMBODIMENT VIII

Using the procedure described in Illustrative Embodiment VII, a test program was carried out with a 1971 Ford 351 CID-2V dynamometer-mounted engine to establish the effect of leaded gasoline on the ORR effect observed with solid acid catalyst additives of the invention. The base gasoline composition employed in this test was the gasoline composition of Illustrative Embodiment VII blended with tetraethyllead to yield a leaded gasoline containing 0.5g of lead per gallon. The acidic additive used in this test was the fluorided alumina ($Al_2O_3$/1% F) of Illustrative Embodiment III at a concentration in the base fuel of 50 mg/gal.

Figure 8:
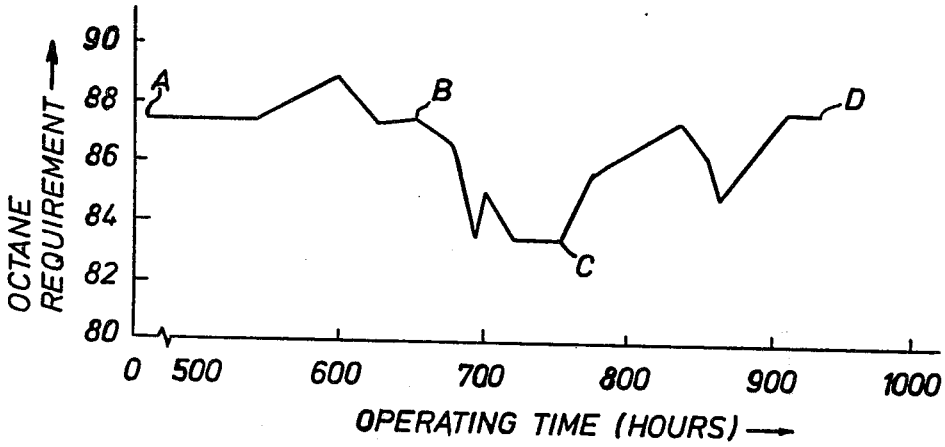

The results of this test program are shown graphically in FIG. 8 which plots operating time versus engine octane requirement, with the operating curve being segregated into line segments according to fuel utilization. In this figure line segments A–B and C–D indicate operation with the leaded base fuel whereas line segment B–C indicates operation with the leaded fuel containing the acidic additive. As shown in the figure, operation with the additive-containing fuel gave a substantial ORR effect (line segment B–C) which was subsequently lost during the operating period with leaded base fuel alone (line segment C–D).

ILLUSTRATIVE EMBODIMENT IX

Using the general procedure described in Illustrative Embodiment VII, a multicylinder engine test was conducted with a 1973 Chevrolet 2-V dynamometer-mounted engine to demonstrate the ORR properties of a lubricating oil formulation of the invention containing a solid acid catalyst additive. The test program utilized in this embodiment included engine operation on an unleaded fuel with engine lubrication being supplied by base lubricating oil without additive and base oil plus additive at periodic intervals through the test. The base lubricating oil employed in this test was a fully-formulated commercial oil (Shell X-100$^R$ 10w/40 Multigrade motor oil) and the acidic solid additive used was the uncalcined amorphous $Al_2O_3$ (29%)/$SiO_2$ (67%) plus 10% faujasitic zeolite additive of Illustrative Embodiment V. For this test, the additive was ground to an average particle size of 2.5 microns and suspended in the base oil at a concentration of from 0.1 to 0.2 g per quart. The gasoline employed in this test was the unleaded fuel composition of Illustrative Embodiment VIII.

Figure 9:
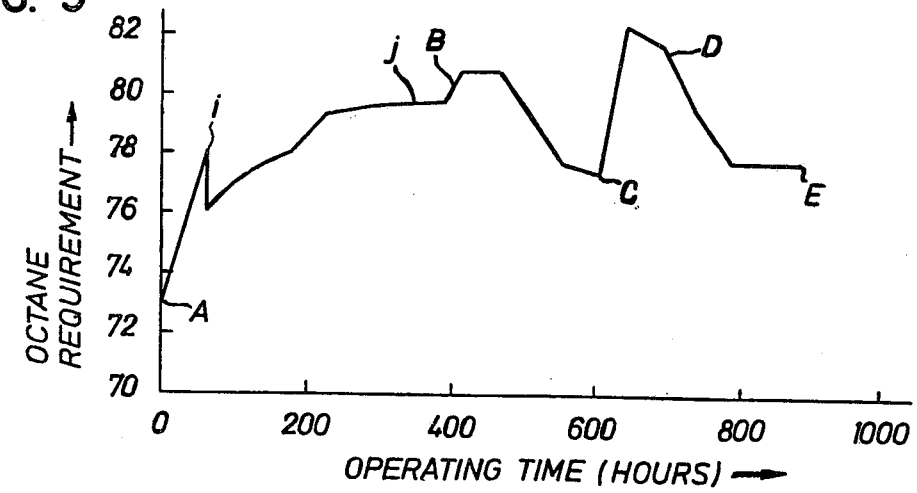

The results of this test are illustrated graphically in FIG. 9 which plots operating time versus engine octane requirement in curve form with the curve being segmented according to motor oil utilization. In this figure, line segments A–B and C–D indicate operation with base lubricating oil while line segments B–C and D–E designate operation with additive-containing lubricant. In this test, the Chevrolet engine has characteristically shown a high initial rate of octane-requirement-increase (ORI) as deposits formed in a clean engine, and in this case ca. 5 PRF ORI was observed after the first 50 hours of operation (point i) along line segment A–B. At this time, the cylinder heads were removed and a portion of the piston crown deposit was selectively removed. The procedure resulted in a two-octane-number decrease in requirement. Following the deposit removal, the requirement was allowed to stabilize for several hundred hours. A normal oil change was conducted at point j (5 quarts of new oil, without the above acidic component), with no observable effect upon engine octane requirement. Stabilized ORI over line segment A–B amounted to about 6 PRF octane numbers prior to the addition of 0.5 gram of the finely-divided acidic additive at point B to the crankcase fluid. No fresh oil was added at this point.

Following the addition of the solid acidic additive at point B, a gradual ORR (ca. 200 hours) of 3 octane numbers was observed over line segment B–C. The magnitude of ORR observed was significantly greater than the typical one octane number drift of stabilized requirement observed with the test methods employed.

Before the magnitude of a "stabilized" ORR could be determined, a large ORI (ca. 5 PRF) was observed (point C). The increase coincided with an inadvertant addition of one quart of motor oil, without acidic additive, during overnight operation. The octane requirement remained at a high level for over 50 hours of operation (line segment C–D), and thus the ORI appeared to be "permanent". Therefore, the crankcase was drained, and 5 quarts of fresh, fully-formulated commercial motor oil containing 1.0 gram of the above acidic component was added at point D. Continued operation along line segment D–E resulted in ORR to about the level observed after the first addition of the acidic additive.

What is claimed is:

1. An improved lubricating oil composition for use in spark-ignition internal combustion engines containing an octane requirement increase-inhibiting amount in the range from about 0.003 to about 15 grams per quart of lubricating oil of a high surface area, refractory solid acid catalyst having:

(a) an average particle size in the range of about 0.01 to about 5 microns, and (b) surface acid centers formed by metallic, hydrocarbon insoluble cations of sufficiently high acidity such that the average non-volatile surface acidity is 1 or less, expressed in pKa units.

2. The composition according to claim 1 wherein the average particle size of the refractory solid acid catalyst is in the range of about 0.5 to 5 microns.

3. The composition according to claim 2 wherein the lubricating oil is a mineral oil-based lubricating oil.

4. The composition according to claim 3 wherein the average non-volatile surface acidity of the refractory solid acid catalyst is between about 1 and about −5, expressed as pKa units.

5. The composition according to claim 4 wherein the surface area of the refractory solid acid catalyst is at least 100 $m^2/g$.

6. The composition according to claim 5 wherein the surface area is in the range of 100 to 700 $m^2/g$.

7. The composition according to claim 5 wherein the refractory solid acid catalyst is selected from the class consisting of metal oxides and halogenated metal oxides.

8. The composition according to claim 7 wherein the refractory solid acid catalyst is a binary oxide of silicon oxide and a metal oxide selected from the class consisting of aluminum, zirconium, titanium and iron oxide.

9. The composition according to claim 7 wherein the refractory solid acid catalyst is a halogenated aluminum oxide.

10. The composition according to claim 8 wherein the refractory solid acid catalyst is silica-alumina with a $SiO_2/Al_2O_3$ weight ratio of from 0.1 to 500.

11. The composition according to claim 1 wherein the refractory solid acid catalyst is a fluorided alumina containing up to about 10% by weight fluorine.

12. An improved method of operating a spark-ignition, internal combustion engine which comprises introducing with the combustion intake charge, and in a lubricating oil carrier an octane requirement increase-inhibiting amount of a high surface area, refractory solid acid catalyst having, (a) an average particle size in the range of about 0.01 to about 5 microns and (b) surface acid centers formed by metallic, hydrocarbon insoluble cations of sufficiently high acidity such that the average non-volatiel surface acidity is 1 or less, expressed in pKa units.

* * * * *